US006696778B2

(12) United States Patent
Doty et al.

(10) Patent No.: US 6,696,778 B2
(45) Date of Patent: Feb. 24, 2004

(54) RIGID BUSBAR FOR A CATHODE-RAY TUBE (CRT)

(75) Inventors: James Edward Doty, Skillman, NJ (US); Joey John Michalchuk, Lambertville, NJ (US); Richard William Nosker, Princeton, NJ (US)

(73) Assignee: Thomson Licensing S. A., Boulogne Cedex (FR)

( * ) Notice: Subject to any disclaimer, the term of this patent is extended or adjusted under 35 U.S.C. 154(b) by 467 days.

(21) Appl. No.: 09/746,263

(22) Filed: Dec. 22, 2000

(65) Prior Publication Data

US 2002/0079812 A1 Jun. 27, 2002

(51) Int. Cl.[7] ..... H01J 29/80
(52) U.S. Cl. ..... 313/407; 313/402; 445/30
(58) Field of Search ..... 324/402, 403, 324/407, 404, 414, 406, 408, 409; 445/30, 66

(56) References Cited

U.S. PATENT DOCUMENTS

| | | | | |
|---|---|---|---|---|
| 5,629,051 A | * | 5/1997 | Poliniak | 427/475 |
| 5,646,478 A | * | 7/1997 | Nosker et al. | 313/402 |
| 2002/0079805 A1 | * | 6/2002 | Michalchuk | 313/402 |

* cited by examiner

*Primary Examiner*—Jay Patidar
(74) *Attorney, Agent, or Firm*—Joseph S. Tripoli; Carlos M. Herrera; Patricia A. Verlangieri

(57) ABSTRACT

An apparatus and method for terminating crosswires on a tension focus mask. The apparatus includes a set of base segment side rails each having a length and two respective ends. A pair of square tubes attached perpendicular to the respective ends of said base segment side rails to substantially form a rectangle. Also included are a pair of massive side rails having a length and two respective ends mounted above said base segments perpendicularly to said square tubes on each of the side rapid. Beam shield is offered to the massive side rail and insulating members are sandwiched between the side rail and a bus bar. Finally, a tension mask is attached and crosswires are laid and affixed to the bus bar.

11 Claims, 4 Drawing Sheets

RIGID BUSBAR FOR A CATHODE-RAY TUBE (CRT)

The invention generally relates to the application of crosswires to a tension focus mask for use in color picture tubes and, more particularly, to a method and apparatus of protecting the edges of mask frame assembly from damage during handling and providing an integral beam shield as well as stabilize the edge strands.

BACKGROUND OF THE INVENTION

A color picture tube includes an electron gun for forming and directing three electron beams to a screen of the tube. The screen is located on the inner surface of the faceplate of the tube and is made up of an array of elements of three different color-emitting phosphors. An aperture mask, which may be either a shadow mask or a tension mask, is interposed between the electron gun and the screen to permit each electron beam to strike only the phosphor elements associated with that beam. A shadow mask is a thin sheet of metal, such as steel, that is contoured to somewhat parallel the inner surface of the tube faceplate. A shadow mask may be either domed or tensioned. A type of tension mask, called a tension focus mask, comprises two sets of conductive elements that are perpendicular to each other and separated by an insulator. Two different voltages are applied to the two sets of elements to create quadropole focusing lenses in each of the mask opening, which form a focus mask. The mask openings are defined by the rectangular space between adjacent vertical lines and adjacent horizontal lines. Generally, in a tension focus mask, a vertical set of conductive lines or strands is under tension and a set of horizontal conductive elements sometimes known as crosswires overlies the strands.

In cathode ray tubes containing tension focus masks, the spatial integrity of the strands and crosswires is critical. The crosswires and strands must not move from their respective positions during tube operation or during tube fabrication. Any such motion of the crosswires could impact the mask strands causing electron beams to misregister with the phosphor elements, during tube operation. It is therefore desirable that the mask structural elements, especially those used to terminate the crosswires, must be rigid.

SUMMARY OF THE INVENTION

The present invention provides an apparatus and method of constructing a rigid busbar for the purpose of preventing damage to a tension focus mask due to handling during the manufacturing process. The apparatus includes a mask frame assembly having a set of short sides constructed by robust steel structural members. The short sides are formed from a base segment formed of a stainless steel 90° extruded angle shape having two respective ends. The 90° extruded base segment forms the bottom and side rail of the short side of the mask frame assembly. This side rail is attached on each of its respective ends to two square tubes that form the long sides of the rectangular mask frame assembly. Above the stainless steel side rail is another larger side rail formed of cold rolled steel in the shape of an angle attached on each end to the square tubes. A set of arched cantilevers are also attached to the ends of the side rails above the point where the square tube is joined to the side rail.

The cantilevers support a tension mask that is welded to each of the cantilevers and whose strands are parallel to the short sides of the mask frame assembly.

Along the outsides of the steel side rails is attached an insulating strip. A set of bus bars are then attached to the outside of the insulating strips. A plurality of crosswires are laid perpendicular to the mask strands and attached on each end to the bus bars.

DETAILED DESCRIPTION

Figure 1:
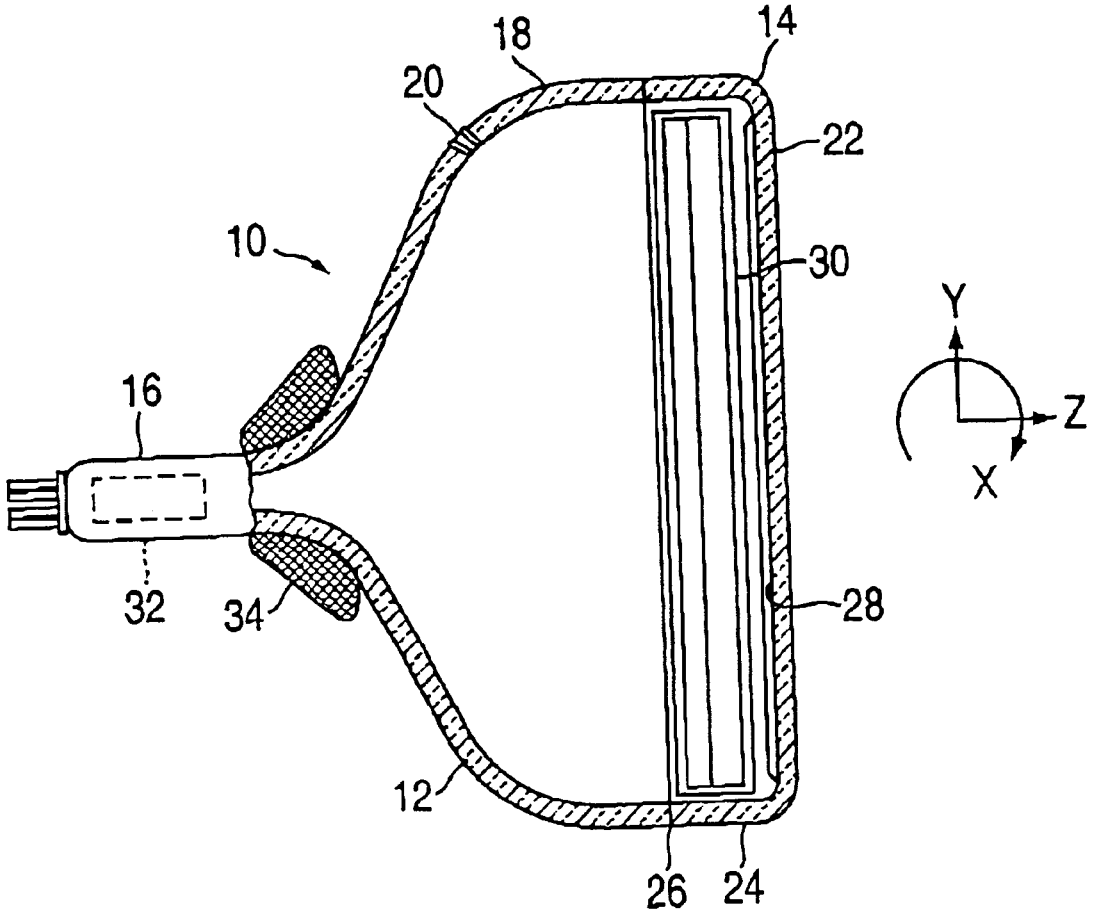
FIG. 1 is a side view, partially in axial section, of a color picture tube, including a tension focus mask assembly according to the present invention.

FIG. 1 shows a cathode ray tube 10 having a glass envelope 12 comprises a rectangular face plate panel 14 and a tubular neck 16 connected by a rectangular funnel 18. The funnel 18 has an internal conductive coating (not shown) that extends from an anode button 20 to a neck 16. The panel 14 comprises a viewing face plate 22 and a peripheral flange or sidewall 24 that is sealed to the funnel 18 by a glass frit 26. A three-color phosphor screen 28 is carried by the inner surface of the face plate 22. The screen 28 is a line screen with the phosphor lines arranged in triads, each triad including a phosphor line of each of the three colors. A tension focus mask 30 is removably mounted in a predetermined spaced relation to the screen 28. An electron gun 32 (schematically shown by the dashed lines in FIG. 1) is centrally mounted within the neck 16 to generate three in-line electron beams, a center beam and two side beams, along convergent paths through the tension focus mask 30 to the screen 28.

The tube 10 is designed to be used with an external magnetic deflection yoke, such as the yoke 34 shown in the neighborhood of the funnel to neck junction. When activated, the yoke 34 subjects the three beams to magnetic fields which cause the beams to scan horizontally and vertically in a rectangular raster over the screen 28.

Figure 2:
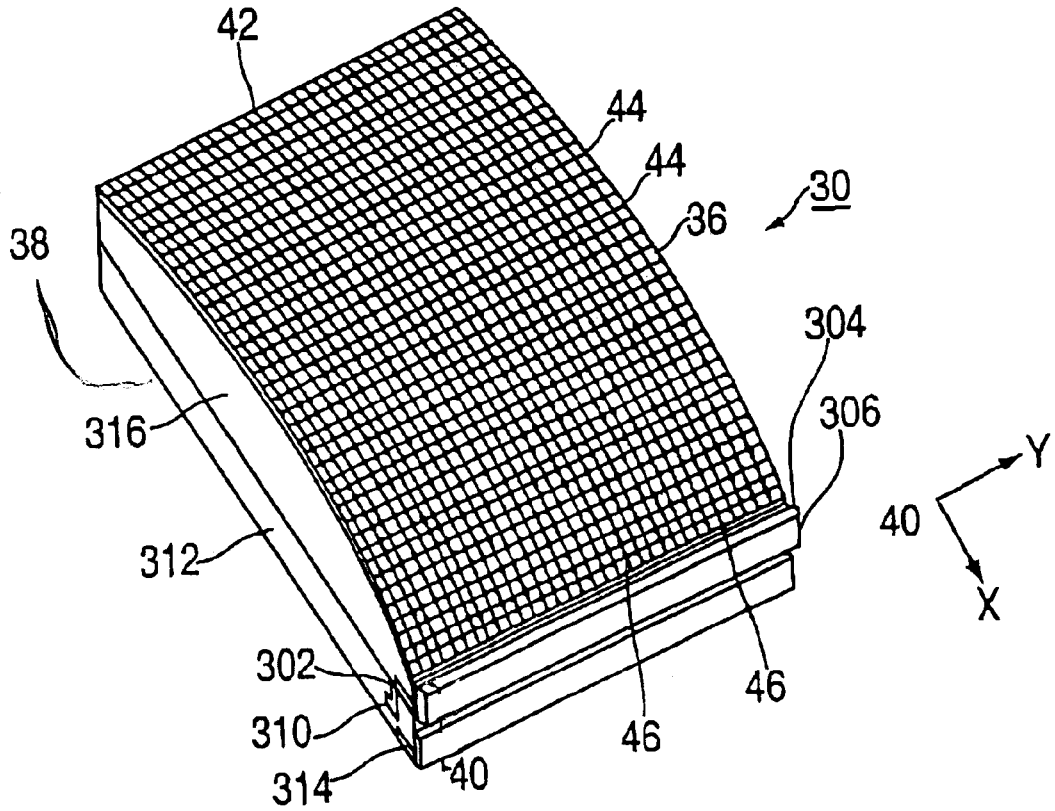
FIG. 2 is a perspective view of the tension focus mask assembly of FIG. 1.

The tension focus mask 30, shown in greater detail in FIG. 2, includes two longs sides 36 and 38 and two short sides 40 and 42. The two short sides 40 and 42 of the mask parallel a central minor axis, Y, of the tube. The tension focus mask 30 includes two sets of conductive lines: strands 44 that are parallel to the central minor axis y and to each other; and wires 46, that are parallel to the central major axis x and to each other. In a preferred embodiment, the strands 44 are flat strips that extend vertically, having a width of about 13 mils and a thickness of about 2 mils, and the cross wires 46 have a round cross section, having a diameter of about 1 mil and extend horizontally. In the completed mask, the strands 44 and wires 46 are separated from each other by suitable insulators such as lead-zinc-boro-silicate.

Figure 3:
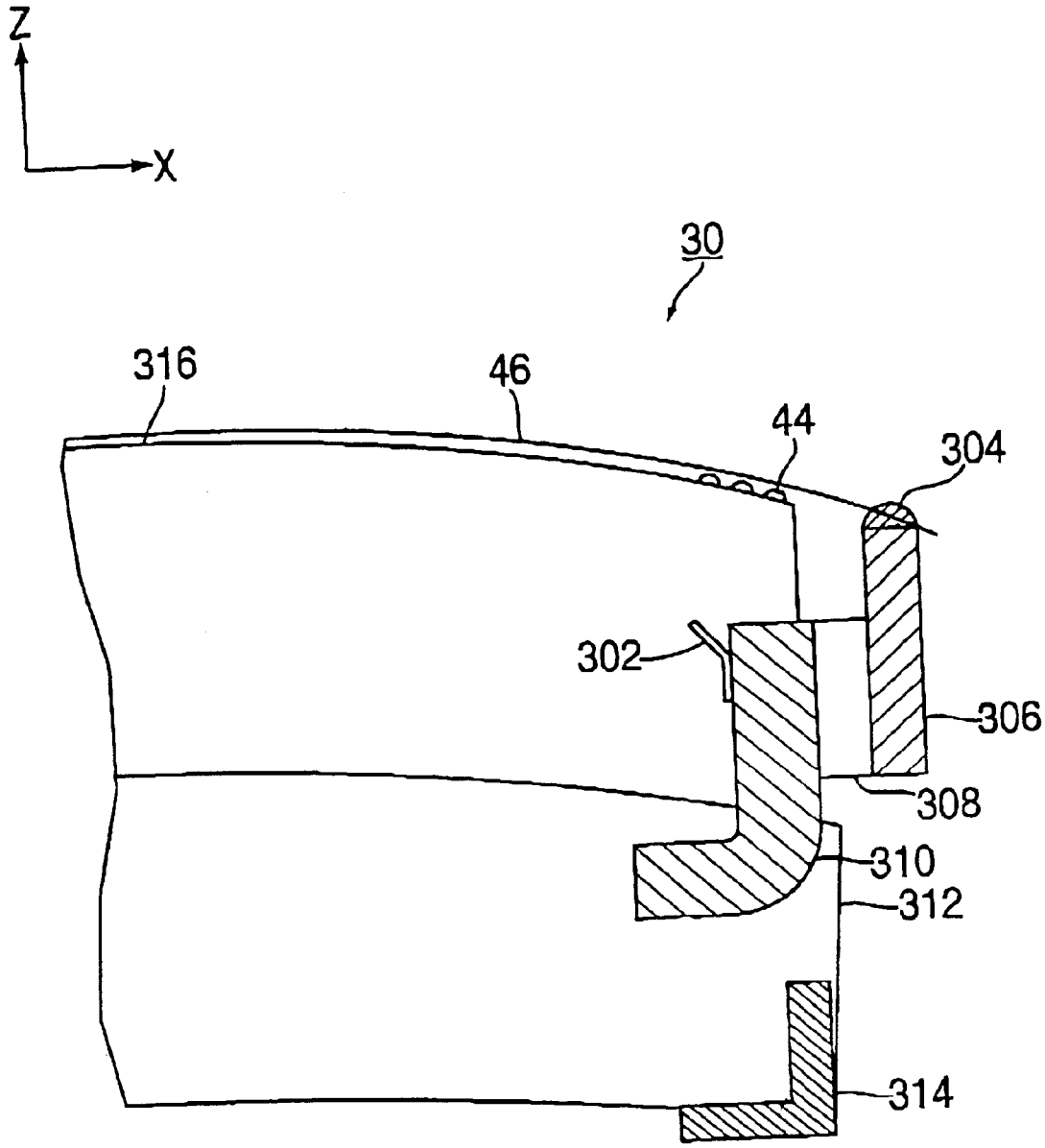
FIG. 3 is a side view, cross-sectional, of the apparatus for terminating crosswires.

FIG. 3 depicts a side view, cross-section, of the tension focus mask 30 for constructing a rigid busbar. To best understand the invention, the reader should simultaneously refer to both FIGS. 2 and 3.

The short sides 40 and 42 of the tension focus mask 30 includes a base segment 314, which can be seen in both FIGS. 2 and 3, formed of a stainless steel 90° angle segment having two respective ends. A massive side rail 310 is formed of an alloy steel material also in the shape of an angle and having two respective ends. Together, these two side rail segments 314 and 310 establish the structural portions of the two short sides 40 and 42. Each side, 40 and 42 are fabricated to mirror one another. The stainless steel base segment 314 is arranged such that it is perpendicular to the long sides 36 and 38 and attached to the long side on each of its respective ends by welding. The second element, the massive side rail 310, is arranged such that it is aligned in the same vertical plane as the first segment 314, but the second segment 310 is positioned above segment 314 in the Z direction.

The massive side rail segment 310 is also affixed to the long sides 36 and 38 on each of its' respective ends, perpendicular to the long sides 36 and 38 similar to that of the base segment 314.

The arrangement of the segments 314 and 310 forms the short sides 42 and 40. This arrangement allows workers and technicians to grasp the tension focus mask 30 without handling the mask portion of the assembly. The side rails also prevent damage when mask frame assemblies are jarred impacted by objects or other mask assemblies during fabrication. The cross wires 46 are especially fragile and require the utmost care to avoid damage.

The massive side rail segment 310 further comprises a set of elements that aids in the performance of the mask frame assembly and allows the assembly to be used as a tension focus mask or a color selection electrode. These elements include a beam shield 302, an insulator/spacer 308 and a rigid busbar 306.

The beam shield 302 is formed along the upper inside portion of the massive side rail 310. The beam shield 302 runs the entire length of the massive side rail 310 and prevents stray electrons from the electron gun 32 of the CRT 10 from scattering and landing on the screen to produce an anomalous effect in the edge regions during use.

The insulator/spacer 308 is affixed to the outside of the massive side rail 310. The insulator/spacer 308 is sandwiched between the side rail 310 and the busbar 306. The insulator/spacer 308 acts to provide electrical insulation for preventing busbar 306 from making electrical contact with the massive side rail 310. The busbar 306 is attached to the outside of the insulator/spacer 308 and runs the length of the short side 40 and 42 of the tension focus mask 30.

A plurality of crosswires 46 of the focus mask are applied over strands 44 and terminate on the busbar 306. The crosswires 46 are laid parallel to one another and equidistantly spaced from each other. The crosswires 46 are affixed to the busbar 306 by, for example, a structural adhesive 304, such as carbon loaded KASIL, applied across the top portion of the busbar 306. After the adhesive 304 has dried or cured, the crosswires 46 are trimmed flush to the busbar 306.

During operation of tube 10, a voltage difference, not shown, is applied between crosswires 46 and strands 44. The voltage is applied to crosswires 46 via the conductivity of busbar 306. Thereby, focus action is provided, in a known manner.

The tension focus mask 30 is assembled in three separate processes. In the first process the frame portion is assembled, while in the second process the etched mask strands 44 are affixed to the tension focus mask 30 and finally in the third process, the crosswire 46 are attached. This forms the frame portion of the tension focus mask 30.

Once all the elements have been properly aligned and assembled, a plurality of crosswires 46 are laid across the top of the busbar 306. The crosswires 46 are glued using a fast-curing, high-temperature adhesive 304 such as carbon loaded KASIL to the top of the busbar 306. After attachment, the crosswires 46 may be trimmed flush with the busbar 306.

Short sides 40 and 42 are reinforced with a rigid busbar 306 for the purpose of preventing damage to tension focus mask 30 due to handling during the manufacturing process. Rigidity refers to the ability of the busbar 306 to resist deformation, during manufacture of the CRT 10 and in use. The busbar 306 is formed to be rigid so as to prevent a transmittal of force to crosswires 46 from, for example, side rail 310. Thereby, advantageously,beam misregister is prevented during use of the CRT 10. For preventing beam misregistration, the deviation of the beam landing location from the ideal on the screen 28 may not be more than 2–4 mils depending on the screen 28 size.

This rigid busbar apparatus allows technicians and workers to handle the tension focus mask 30 by the short sides 40 and 42 at base segments 314, thus preventing physical contact with tension focus mask 30 that could potentially damage the crosswires 46 and strands 44.

Figure 4:
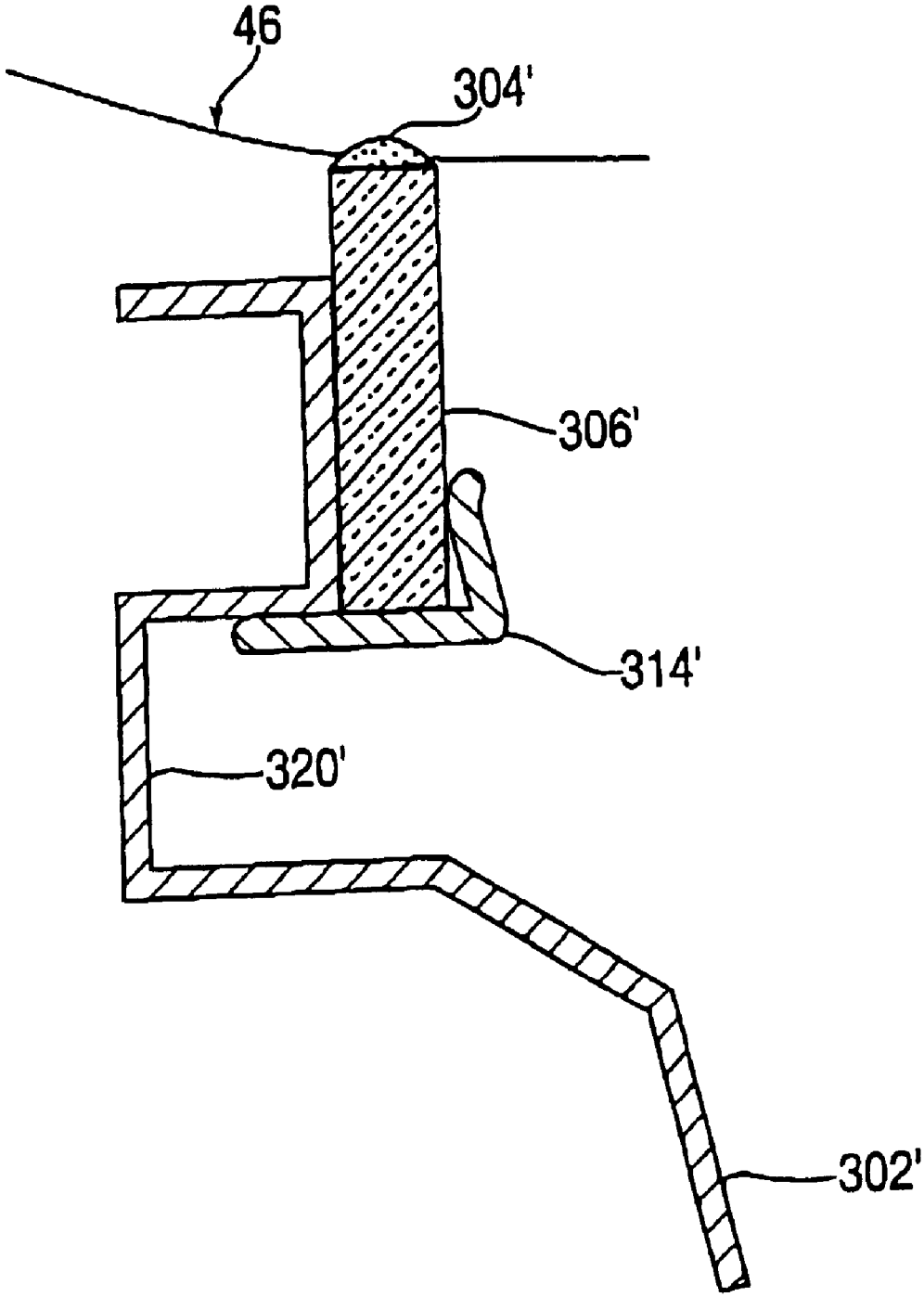
FIG. 4 is a side view, cross-sectional, of another embodiment of the present invention.

FIG. 4 is a side view, cross-sectional, of another embodiment of the present invention. In this embodiment, a rigid busbar 306' is supported by a frame assembly 320'. Rigid busbar 306' is made of an insulator such as glass. An electrically conductive layer, not shown, provides a connection for a focus voltage, not shown. In this embodiment as in the previous embodiment, the rigid busbar 306' prevents the tension focus mask crosswires 46 from damage or shifting during manufacture and use. A busbar clip 314' secures the rigid busbar 306 to the mask frame 320'. An adhesive 304' that may be structural or non-structural is used to adhere the crosswires 46 to the rigid busbar 306'. The adhesive 304' is applied over the crosswires 46 onto the busbar 306' and allowed to cure or dry. As in the previous embodiment, the rigid busbar 306' will not deform during manufacture and will prevent electron beam misregistration.

As the embodiments that incorporate the teachings of the present invention have been shown and described in detail, those skilled in the art can readily devise many other varied embodiments that still incorporate these teachings without departing from the spirit of the invention.

What is claimed is:

1. A tensioned focus mask of a cathode ray tube, comprising:

a plurality of crosswires;

a rigid busbar having a surface for attaching said crosswires to said surface, said rigid busbar having a rigid construction for preventing deformation of said crosswires when an external force is applied to said rigid busbar; and a mask frame for supporting said rigid busbar.

2. The apparatus of claim 1, wherein the rigid busbar is formed of an insulating material.

3. The apparatus of claim 2, wherein the insulating material comprises glass.

4. The apparatus of claim 1, wherein the plurality of crosswires are attached to the busbar by an adhesive.

5. The apparatus of claim 1, wherein the rigid construction of the rigid busbar prevents misregister of the electron beam on the screen.

6. A method for terminating crosswires on a tension focus mask, said method comprising:

(a) providing an insulated busbar;

(b) attaching a mask frame to said insulated busbar such that said insulated busbar is insulated from said mask frame; and (c) attaching a plurality of crosswires to said insulated busbar.

7. The method as described in claim 6 wherein the steps of providing an insulating busbar further comprises forming said busbar that is rigid.

8. The method as described in claim 6 further comprising the steps of insulating the busbar from the mask frame by placing a spacer between the mask frame and the busbar.

9. The method as described in claim 6 further comprising the steps of aligning the crosswires such that they are parallel to each other and equidistantly spaced from each other.

10. The method as described in claim 6 further comprising the steps of applying an adhesive to adhere the crosswires to the busbar.

11. A tensioned focus mask of a cathode ray tube, comprising:

a plurality of crosswires;

a busbar having rigidity provided by an insulating material and a surface for attaching said crosswires to said surface; and a mask frame for supporting said busbar.

* * * * *